United States Patent [19]

Shaw

[11] 4,279,422

[45] Jul. 21, 1981

[54] BOARD GAME INVOLVING MULTIPLE VARIABLES AND PERFORMANCE DETERMINATION

[76] Inventor: Mark Shaw, 1326 Colorado St., Manhattan, Kans. 66502

[21] Appl. No.: 20,657

[22] Filed: Mar. 15, 1979

[51] Int. Cl.[3] ..... A63F 3/00

[52] U.S. Cl. ..... 273/256; 273/243; 273/139

[58] Field of Search ..... 273/243, 256, 254, 257, 273/142 R, 142 J, 139

[56] References Cited

U.S. PATENT DOCUMENTS 4,065,131 12/1977 Martin ..... 273/243

FOREIGN PATENT DOCUMENTS 801964 6/1958 United Kingdom ..... 273/243

*Primary Examiner*—Richard C. Pinkham
*Assistant Examiner*—R. Carl Moy
*Attorney, Agent, or Firm*—John R. Ley

[57] ABSTRACT

A game simulates attending college. Apparatus of the game includes a game board upon which two separate paths of play are defined. One path of play is a college path which represents various academic and financial occurrences which befall the student-player. The other path defines a financial path which represents various financial occurrences which befall the player while working and not attending college. Each path is defined into intervals which designate various rewards or credits or detriments. Play begins on the financial path with the objective being to collect sufficient funds to attend college. Play continues on the college path once sufficient funds have been obtained. While playing on the college path, college credits or detriments are collected and are attributed to college classes or events attempted during each round of play on the college path. A performance determination in the form of a grade point average is derived by play on the college path. If the expenses of attending college exceed the funds collected by any player, play must be transferred back to the financial path. Play remains on the financial path until sufficient funds are collected to once again return to the college path.

3 Claims, 9 Drawing Figures

BOARD GAME INVOLVING MULTIPLE VARIABLES AND PERFORMANCE DETERMINATION

BACKGROUND OF THE INVENTION

1. Field of the Invention

This invention relates to a game of entertainment and amusement, and more particularly to a game involving a game board and various other game apparatus wherein a performance determination of the quality of execution of the game and speed determines the winner. Even more specifically, the present invention relates to an entertainment game in which the event of attending college is amusingly simulated.

2. Introduction and Brief Description of Prior Art

A variety of different board games are known. Typically, the objective of these games is the accomplishment of a single result, such as, amassing the greatest amount of wealth, outlasting all of the other players, or accomplishing an event within the shortest time. Many of these games also include diversions and contingencies which befall the player and temporarily prevent progression toward the ultimate objective of the game. Of course, the interaction of the players under these variables and in the simulation of real life events provide the enjoyment and amusement derived from playing the game.

Even though a variety of techniques and arrangements are known to those skilled in this particular art, comprehension of the desirable aspects of the present invention should not diminish the significance of the present invention.

SUMMARY OF THE INVENTION

The present invention provides a new and improved board game wherein variables relating to game performance, speed of execution and the ability to sustain play determine the winner. Game performance is measured over a predetermined number or series of events which must be accomplished in order to win the game. Game performance is determined by a performance quotient which is the ratio of the number of obtained performance credits to the number of events. The quality of play by each player is thus determined by the average performance quotient for each of the series of events. To sustain play in the game, each player must accumulate subsistence rewards in a predetermined relationship to subsistence detriments. Typically, the subsistence rewards must exceed the subsistence detriments. The player able to sustain play sufficiently long to accumulate the highest number of performance credits while first accomplishing the predetermined series of events wins the game. Thus, the multiple and interrelated variables involved in winning the game are attaining a high performance quotient over each of the predetermined series of events, accumulating performance credits and avoiding performance detriments, accumulating subsistence rewards and avoiding subsistence detriments, and attempting to accomplish all of the foregoing with the most rapid performance.

The preferred aspect of the present invention involves simulating the events surrounding a student's progression through college. The game of "College" comprises a game board upon which two non-intersecting separate paths of play are defined. One path of play simulates various financial rewards and detriments obtained while working outside of college. This path of play defines a subsistence or financial path by which financial resources are obtained to attend college. Intervals on the subsistence path include those from which the player can accumulate money and those from which the player is required to expend money. Once the player has accumulated sufficient money to attend college, play is transferred to the second path of play which simulates events which may befall the student-player while attending college. On the college path, which defines a performance path by which the scholastic performance of the student in college is measured, the player accumulates performance credits or detriments in the form of grade credits or failures from each of a series of classes or events which must be taken or accomplished. The college path also includes intervals from which the player attains or is required to pay money. Once the player no longer has sufficient financial resources to continue attending college, as is represented by play on the college path, play is transferred back to the financial path. Graduating from college requires completion of a number of complete rounds or years on the college path, until a player has attributed grade credits to each of the required number of classes. The winner is the player who has the highest grade point average or performance quotient of any player then engaged in completing the last round of the college path. Other apparatus involved in the preferred embodiment includes a multiple grade guesser, which includes means for randomly supplying a grade or credit for a class. The multiple grade guesser may be utilized by a player at the completion of a round of the college path.

A more complete understanding of the invention, as well as its significant features, can be obtained from the following detailed description of the preferred embodiment taken in conjunction with the drawings briefly described below.

DESCRIPTION OF THE PREFERRED EMBODIMENT

Figure 1:
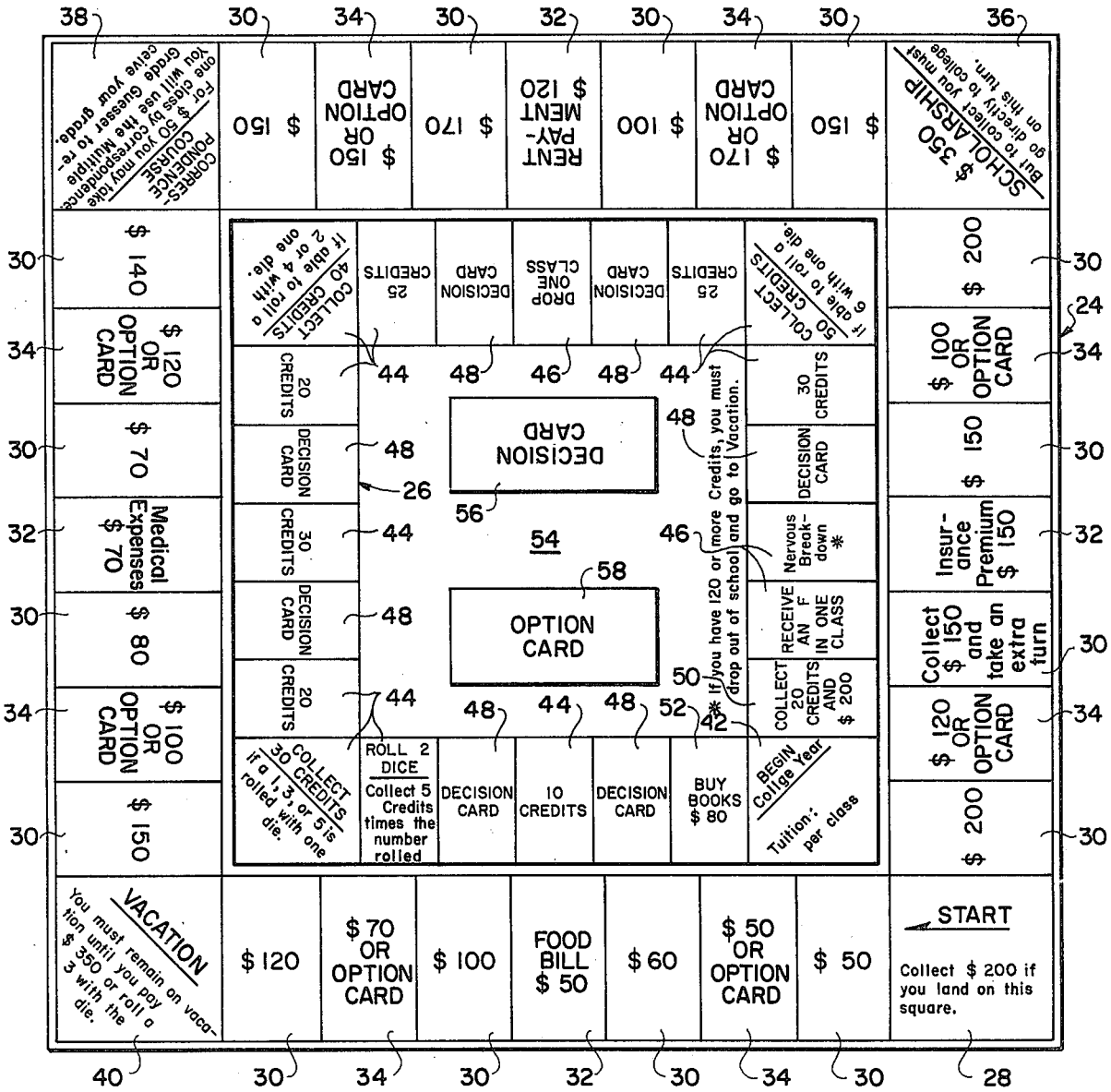
FIG. 1 is a plan view of a game board employed in the preferred embodiment of the present invention.
Figure 2:
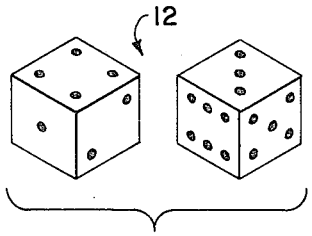
FIG. 2 is a perspective view of a pair of dice employed in the preferred embodiment.
Figure 3:
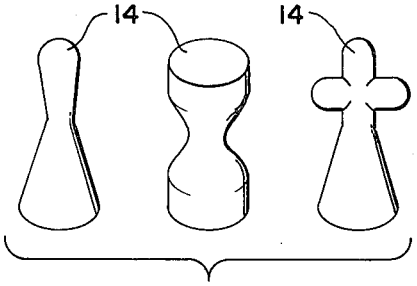
FIG. 3 is a perspective view of a plurality of playing pieces employed in the preferred embodiment.
Figure 6:
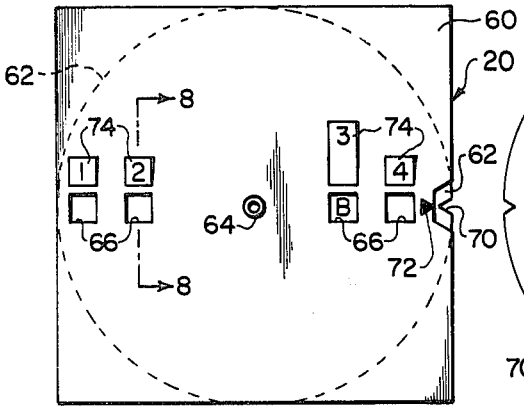
FIG. 6 is a plan view of a multiple grade guesser employed in the preferred embodiment.
Figure 7:
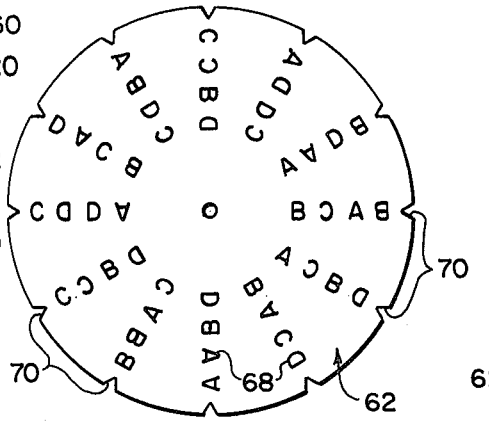
FIG. 7 is a plan view of an element of the multiple grade guesser shown in FIG. 6.
Figure 8:
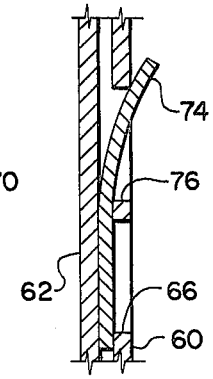
FIG. 8 is an enlarged view of a partial section taken substantially in the plane of line 8—8 of FIG. 6.
Figure 4:
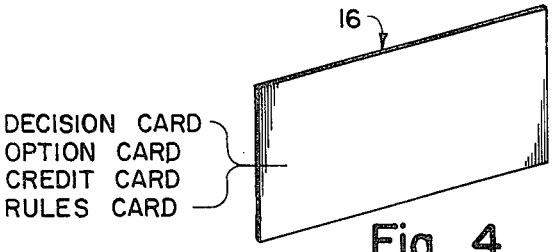
FIG. 4 is a perspective view of one of many different types of cards employed in the preferred embodiment.
Figure 5:
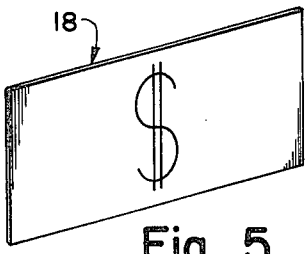
FIG. 5 is a perspective view of game money employed in the preferred embodiment.
Figure 9:
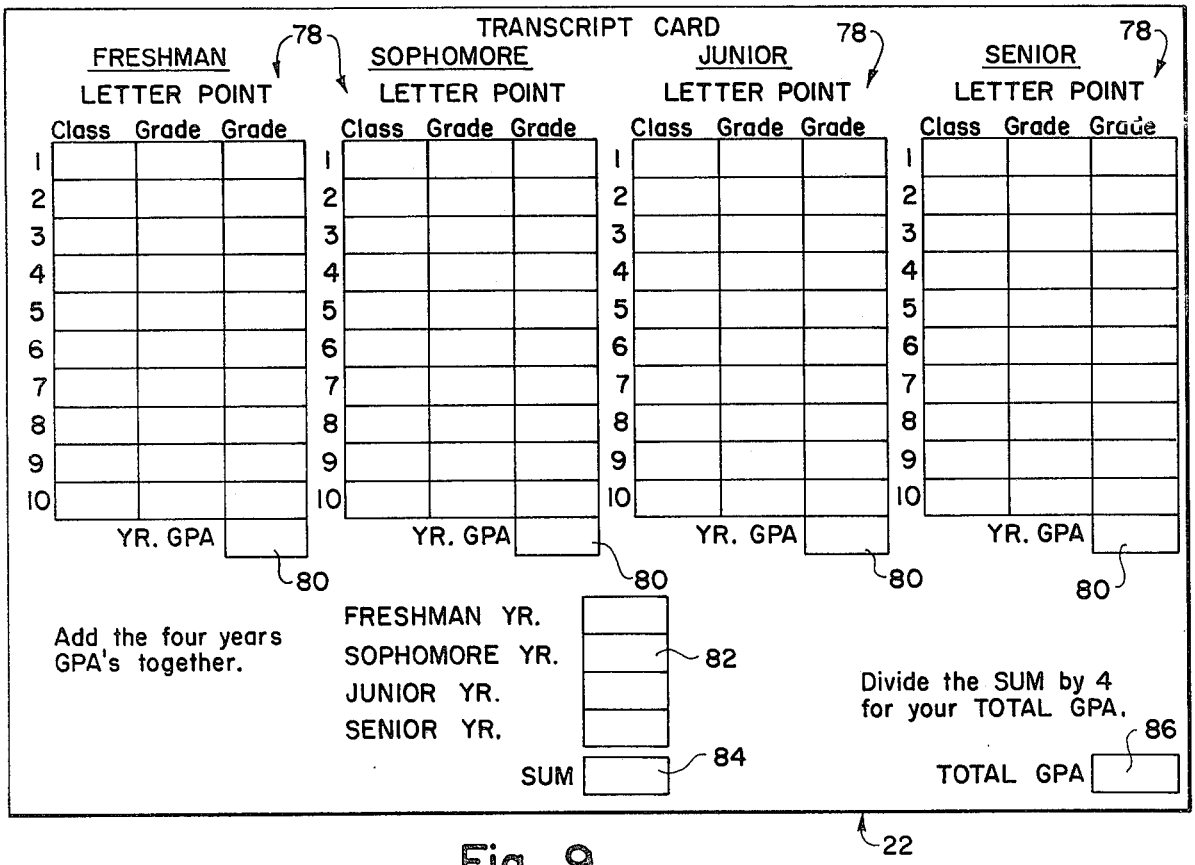
FIG. 9 is a plan view of a transcript card employed in the preferred embodiment.

Apparatus of the present game comprises a game board 10 shown in FIG. 1, a random number generating means such as a pair of dice 12 shown in FIG. 2, a plurality of preferably six playing pieces 14 shown in FIG. 3, a plurality of various cards 16 shown in FIG. 4 which are decision cards, option cards and credit cards, game money 18 shown in FIG. 5, a multiple grade guesser 20 shown in FIGS. 6 to 8, and a transcript card 22 for each player shown in FIG. 9. Also included are a set of rules which may be in printed form (such as on a card 16) which serve as means by which play of the game is dictated.

The game board 10 is preferably formed of a durable base material. The game board presents a playing surface which is defined into a subsistence playing path or financial path 24 and into a performance playing path or college path 26 by, for example, printed indicia on the playing surface. Each playing path 24 and 26 is formed by a plurality of serially connected intervals 28 to 52 and each path is arranged in a continuous unending loop. The paths 24 and 26 are separate from one another and do not intersect one another, i.e., do not have any interval in common. Each of the intervals is marked with a designation of its type and nature.

The financial path 24 begins and ends at the same reference interval 28 marked "START". The intervals 28 to 40 of the financial path 24 define first stage play requirements and represent financial occurrences which might befall a person when working and not attending college. Intervals 30 designate various subsistence rewards or financial rewards which the player receives when the playing piece 14 terminates movement on the intervals 30. Intervals 32 designate subsistence detriments or financial detriments which befall the player when the playing piece 14 terminates movement on the intervals 32. Intervals 34 represent option intervals. A majority of the intervals of the path 24 are subsistence reward or detriment intervals. Upon a playing piece terminating movement on an option interval 34, the player can choose between the financial reward or detriment indicated on the interval 34 or alternatively may choose one of a plurality of option cards. As will be described subsequently, each option card has printed thereon one of a variety of different financial rewards and detriments. Various other intervals, such as the intervals 28, 36, 38 and 40 also involve financial rewards or detriments, and some intervals, for example 36 and 38, also involve occurrences relating to play on the college path 26.

The college path 26 begins and ends at the same reference interval 42 marked "BEGIN". The intervals 42 to 52 of the college path 26 define second stage play requirements and represent various academic and financial occurrences which might befall a person when attending college. Intervals 44 of the path 26 designate the amount of performance credit or college credit received by the player when the playing piece terminates movement on the intervals 44. Intervals 46 designate the amount of performance or college detriment or college failure received by the player when the playing piece terminates movement on the intervals 46. Intervals 48 are designated as decision intervals. Upon the playing piece terminating movement on intervals 48, the player must select one of a plurality of decision cards. Each decision card will be described in detail subsequently, but in general, each of the decision cards sets forth a decision and the player must choose between receiving college credit or detriment on one hand or financial reward or detriment on the other hand. In addition, a few of the intervals, for example intervals 50 and 52, designate that the player is to receive financial credit or detriment, respectively, upon the playing piece terminating movement on the intervals 50 and 52.

The financial path 24 is preferably arranged around the periphery of the game board 10. The college path 26 is positioned next inward from the financial path, thereby leaving an open space 54 at the center of the game board. Positions 56 and 58 are marked on the open space 54 in which the decision and option cards respectively are to be positioned. The various intervals, paths, positions and spaces on the game board 10 may be distinguished from one another by the indicia thereon and by coloring.

The pair of dice 12 shown in FIG. 2 serve as random number generating means when rolled. The spots on the dice represent the numbers generated. When playing the game, both dice 12 are used in moving around the financial path 24, and one die is used in moving around the college path 26.

Preferably six playing pieces 14 are utilized. The playing pieces are distinguished from one another by configuration or coloring or other suitable means. Each player uses only one playing piece. The intervals defined on the game board 10 support the playing pieces 14 during movement. With each number generated by one or more of the dice 12, each playing piece advances a corresponding number of intervals. The movement of each playing piece according to the number generated by one roll of at least one die defines one turn. The players move their playing pieces in rotation.

Option cards, decision cards, and credit cards are utilized in the game. Each of the cards is similar to the card 16 shown in FIG. 4. Each card is made of a durable material such as lightweight cardboard. On the front side of the card, the type of card is printed, i.e., decision card, option card, or credit card. Printed on the reverse side of the card is a description of the subject matter involved for each particular card.

DECISION CARDS

Preferably, seventeen decision cards are employed in the game. The subject matter printed on the reverse sides of the seventeen cards is set forth below:

1. Must lose either 10 credits or $120.
2. Must lose either 10 credits or $120.
3. May receive either 10 credits or $120.
4. May receive either 20 credits or $200.
5. May receive either 30 credits or $300.
6. May receive either 30 credits or $300.
7. May receive either 40 credits or $400.
8. Roll one die, each spot is worth 5 credits.
9. Pay rent: pay $200 or lose 20 credits, because must find part time job.
10. Test: receive 10 credits or roll the die. Roll a 2, 4 or 6 and collect 40 credits; roll a 1, 3 or 5 and lose 20 credits.
11. Test: receive 10 credits or roll one die. Roll a 1, 3 or 5 and collect 40 credits; roll a 2, 4 or 6 and lose 20 credits.
12. Optional. Offered job: must quit school (but may return after one round on financial path). If you leave collect $1500 and return to START.
13. Optional. Chance to quiz out. Pay $50 for a chance at the multiple grade guesser (May keep or throw away the grade).
14. Optional. Chance to cheat on test. Roll die; if you roll a 1, 2, 4, 5 or 6 collect 20 credits; but if you roll a 3 then you receive an 'F' for one class.
15. Optional. May study: lose one turn—receive 15 credits; two turns—30 credits; three turns—60 credits.
16. Optional. May study: lose one turn—receive 15 credits; two turns—30 credits; three turns—60 credits.
17. Optional. Bribe your professor. (Limit 40 credits-)—$400—40 credits; $200—20 credits; $100—10 credits.

The decision cards numbered 12 through 17 above are designated as optional. The player may, at his election, choose whether or not to do as the optional decision card describes. If the player elects not to proceed as described on the optional decision, the player's playing piece 14 remains on the interval 48.

When used during playing of the game, the decision cards are randomly shuffled and placed in a stack with their reverse sides down on the decision card position 56 of the game board 10. Upon the playing piece of a player terminating movement on a decision interval 48, the player selects the uppermost decision card in the stack. In this manner the shuffled stack serves as means for randomly supplying one of a plurality of decisional choices regarding college credits and detriments and financial rewards and detriments. The card is placed reverse side down at the bottom of the stack after it is used.

OPTION CARDS

Preferably, seventeen option cards are employed in the game. The subject matter printed on the reverse sides of the option cards is as follows:

"Collect $20" is printed on two cards.
"Collect $50" is printed on two cards.
"Collect $70" is printed on one card.
"Collect $100" is printed on two cards.
"Collect $150" is printed on two cards.
"Collect $200" is printed on two cards.
"Collect $250" is printed on two cards.
"Collect $300" is printed on one card.
"Collect $500" is printed on one card.
"Lose $70" is printed on one card.
"Lose one turn or $50" is printed on one card.

When used during playing of the game, the option cards are randomly shuffled and placed in a stack with their reverse sides down on the option card position 58 of the game board 10. Upon the playing piece terminating movement on an option interval 34, the player must choose to receive either the financial credit or detriment indicated on the interval 34 or may choose an option card. The shuffled stack of option cards serves as means for randomly supplying one of a plurality of optional choices of financial rewards or detriments. The card is placed reverse side down at the bottom of the stack after it is viewed.

CREDIT CARDS

Credit cards are provided so that each player may readily keep track of the amount of college credits received when traversing the college path 26. On the reverse sides of the credit cards, the amount of credits is printed. Any sufficient number of credit cards are provided, but the following numbers have proved sufficient. Twenty credit cards have designations of "20 credits" printed on their reverse sides. Fifteen cards have designations of "10 credits" printed on the reverse sides, and ten cards have designations of "5 credits" printed on the reverse sides.

Sufficient game money 18 is supplied to accommodate all of the players. The game money may be printed in desired and practical demonations.

The multiple grade guesser 20 shown in FIGS. 6–8 is one form of means for randomly supplying one of a performance credit or performance detriment for a performance event or class taken. The multiple grade guesser 20 includes a top cover member 60 and a wheel member 62. The wheel member 62, is connected by a pin 64 to the cover member 60. Four windows 66 are formed through the cover member 60 so as to expose class grades or performance indicia 68 printed or otherwise formed on the wheel member 62. The windows 66 and performance indicia 68 are aligned diametrically in rows with respect to the pin member 64. Notches 70 are formed on the outer periphery of the wheel member 62 in diametric alignment with the rows of printed indicia 68. A reference indicator 72 is formed on the cover member 60. Upon alignment of the notches 70 with the reference indicator 72, the performance indicia 68 is aligned for viewing through the windows 66. An opaque flexible window cover member 74 extends through a slot 76 formed in the cover member 60 in alignment with the windows 66. When the window cover member 74 is inserted maximumly into the slot 76, the window 66 is covered, as shown in FIG. 8, and the performance indicia are hidden. Upon retracting the window cover member 74, the indiciation 68 on the wheel member is exposed through the window.

The performance indicia 68 on the wheel member 66 shown in FIG. 7, are randomly arranged in the rows so that the performance indicia do not consistently appear at the same windows. By randomly rotating the wheel, different performance indicia are randomly positioned beneath the windows 66. The connection at the pin 64 provides enough flexibility between the members 60 and 62 so that rotation of the wheel member 62 does not dislodge the window cover members 74.

The transcript card 22 includes indicia formed thereon as shown in FIG. 9 and is a means by which each player records his performance and obtains a performance quotient in the form of a grade point average or G.P.A. for his college career or game. Forty college classes or performance events must be accomplished or attended in order to win the game. Preferably, ten classes will be accomplished or attended during each of the four years in college. A lined grid 78 for each of the freshman, sophomore, junior and senior years is provided on the transcript card 22. Vertical columns in each grid 78 relate to the classes or events attempted and accomplished, the letter grade attained for each class, and the number of grade points corresponding to the letter grade received for each class. Horizontal rows relate to the ten courses to be taken during each year. A box 80 is provided in each grid 78 for recording the G.P.A. or performance quotient obtained for each group of ten classes. The G.P.A. for the group of ten classes is obtained by dividing the total of the grade points by ten. A second lined grid 82 includes a single column by which the G.P.A.'s of each of the four groups of ten classes is added and recorded in box 84. A last box 86 shows the overall performance quotient or college G.P.A. calculated by dividing the sum recorded in box 84 by four.

The rule of the game control playing of the game and dictate movement of the playing pieces 14 over the paths 24 and 26 of the game board 10 and also dictate the amounts of financial reward and financial detriment and performance credit and performance detriment attributed to each playing piece and player in accordance with the movement of the playing pieces over the game board. The manner in which the game is played is apparent from a description of the game rules.

In preparation, the decision and option cards are randomly shuffled in their respective stacks and the stacks are placed on the positions 56 and 58 respectively on the game board 10. One playing piece 14 is selected by each player and positioned on the start reference interval 28 of the financial path 24. Each player obtains a transcript card 22. All players begin without money. A rotational sequence of players is established, as for example by each of the players rolling the pair of dice 12 and the player with the highest score beginning, followed by the sequence of players to the left of the highest scorer.

Play begins on the financial path 24, because each player starts without financial rewards and because money is needed to pay tuition to enter college. When playing on the financial path 24 both dice 12 are rolled to advance the playing pieces clockwise. Each player takes a turn by rolling the dice and moving the playing piece the number of intervals equal to the number supplied by the dice. At the end of each turn, the interval upon which the playing piece has terminated movement designates the financial reward or detriment which the player must collect from or pay to the bank of game money. If the player does not have sufficient funds to pay financial detriments when on the financial path, only the amount the player has on hand need be paid. No money is loaned or owed in the game. Of course, landing on an option card interval 34 allows the player to select either the option card or the amount of financial reward or detriment on the interval 34.

To enter college, that is, begin play on the college path 26, one round or circuit of the financial path must have been completed and sufficient funds to pay the college entrance tuition must have been gained. The amount of college entrance tuition is determined by the number of classes or performance events which the player elects to take or try to accomplish during that round of play on the college path 26. The selected number of classes for each round are designated by marking X's in the appropriate column of the grids 78 of the transcript card 22. The player may choose any number of classes from one to fifteen for each round on the college path. The suggested number of classes is ten, but some players may wish to attempt completing college in less than fours years. The suggested amount of tuition to be paid for each class attempted is $60 per class. The tuition amount is designated on the "BEGIN" interval 42 in the blank space provided.

To enter college, the player moves the playing piece from the start reference position 28 to the begin reference position 42 upon one completion of a complete round of the financial path 24. The player's turn terminates upon movement of the playing piece to the begin reference interval 42. Once on the college path 26, only one die is rolled to dictate clockwise advancement along the college path. After each roll of the die the designated amount of performance credit or detriment and the amount of financial reward or detriment indicated on the interval upon which the playing piece terminates movement at the end of the turn is attributed to the playing piece. Upon the playing piece terminating movement on a decision interval 48, a decision card must be selected. Some of the decision cards are optional and others are not. Action must proceed in accordance with the dictates of a non optional decision card, but the player can elect whether or not to act in accordance with an optional decision card. Upon landing on any of the performance credit intervals 44, credit cards are collected in the amount of credit indicated.

Once in college, if the player is unable to pay any financial expenses or detriments, the playing piece must immediately and directly return to the start reference interval 28 of the financial path 24 and progression around the financial path must be resumed to earn sufficient funds to return to college. Failure to pay expenses while in college will result in forfeiture of all tuition paid and college credits collected during that uncompleted round of the performance path or attempted period in college.

Only after finishing each complete round of the college path 26, each player must fill out his transcript card for the number of classes selected during that round. First, the player attributes performance credits collected in that round to the selected classes. For each 20 credits received, the player receives an 'A' for the class. For each 15 credits, a 'B' is received, and for each 10 credits a 'C' is received. The player may attribute all collected credit in any way to achieve the grades desired. Most players will elect to apply the collected credits toward class grades, but the player is not required to attribute any credits to attempted classes. For example, if the player has used all credits but 10, the player is not required to take a 'C' for one of the classes. The player is not forced to take less than a 'B' for a class, since winning the game usually requires a 'B' average. Once the letter grade for the classes are established, point grades corresponding to the letter grades are inserted in the appropriate columns of the transcript card. The letter grade and point grade correspondence is 4.0 points for an 'A', 3.0 points for a 'B', 2.0 points for a 'C', and 1.0 and 0.0 points for a 'D' and 'F' respectively.

If the player does not fill all of his classes with grades by using the credits collected during the round, the player has two alternatives. One alternative is that the player may drop any of the remaining classes by removing the X designations from the transcript card indicating attempted classes. Dropping classes allows the player to keep a high G.P.A., but since the dropped classes have to be taken again, dropping classes hinders the player in the race to graduate or complete all of the predetermined total number of forty classes. The other alternative is that the player may use the multiple grade guesser 22 to obtain grades for the remainder of the classes or any of the attempted classes to which the player did not attribute credits. The multiple grade guesser allows the player-student to guess grades he would have received by not studying. To use the multiple grade guesser another player randomly turns the wheel member 62 until a notch 70 aligns with a reference indicator 72. The guessing player retracts one of the four window cover members 72 and thereby exposes the grade which he receives for the class. The grade exposed behind the window must be attributed to one of the classes. After each guess, a similar procedure is repeated for each of the other classes for which the player is guessing grades.

A player with sufficient money to pay the tuition for the classes involved in an additional year of college or round on the college path 26 on the college path. A player remaining on the college path must terminate the last time of each round on the college path on the beginning reference position 42. Further movement of the player's playing piece beyond the interval 42 on the college path must commence with the player's next turn. The player must pay the tuition each time the playing piece terminates the previous round on the begin reference interval 42 on the college path and before starting the next round. Any remaining college credits unused from a previous round as described above, must not be retained for use in the next round.

If the player is unable to pay the tuition for an additional round on the college path, the player must return to the financial path 24. Leaving the college path and entering the financial path for lack of tuition funds occurs by moving the playing piece from the begin reference interval 42 to the start reference interval 28. The count of the die roll in the turn when transfer occurs is continued on the financial track, with one movement interval being from the begin reference interval 42 to the start reference interval 28.

After each ten classes the grade point average is determined and entered in the boxes 80 of the transcript card. The G.P.A. is also entered in the appropriate row of the second grid 82. Upon completion of the game the G.P.A. for each year is added in the second grid 82, the sum is recorded at 84, the sum is divided by 4 and the result entered in the box 86. The college average G.P.A. or total performance quotient is thereby determined.

The winner of the game is the first player to complete forty classes with the highest total G.P.A. A G.P.A. of at least 3.0, a 'B' average, must be obtained to win the game. If more than one player is in the last round on the college track 26 when one player first finishes the last round on the college track, the first player to finish must wait until all the other players in the last round of college complete the round. The winner is determined among the players who complete the final round by that player who has the highest total G.P.A. Any players not in the final round on the college path when the first player finishes with a 3.0 or higher G.P.A. must remove their playing pieces from the board. If there are no other players in the final round on the college path when the first player finishes the last round the first player is the winner provided that the player has attained a total G.P.A. of at least 3.0.

It is apparent from the foregoing description that the present invention humorously and amusingly simulates occurences associated with college. The multiple variables involved in the game, such as obtaining sufficient subsistence or money to continue along the performance or college path, attainment of a high G.P.A. or performance quotient, requiring that a plurality of separate rounds over the college path be executed before the game can be won so as to obtain an average performance over each round, and the necessity to be as quick as possible in going to college and accomplishing the events or taking the classes create suggest potential advantages and hazards and allow opportunity for skillful execution and accomplishment of game play.

The preferred arrangement of the present invention has been described with a degree of particularity. It should be understood, however, that the degree of specificity is not intended to unnecessarily restrict the spirit and scope of the invention defined in the appended claims.

I claim:

1. Board game apparatus simulating occurrences of attending college, comprising:

a plurality of playing pieces, each playing piece representing one player during use of said board game apparatus;

a game board having a playing surface and including means defining two separate playing paths on the playing surface, each playing path defined by a plurality of separate intervals serially linked in an unending continuous loop, said intervals defining movement increments of each playing piece along each playing path, one of the playing paths defining a financial path representing financial occurrences occurring when in a working situation, the other of the playing paths defining a college path representing academic and financial occurrences occurring during the simulated event of attending college, said board game further including indicia means designating each interval of each path as a particular type of interval, the majority of the intervals of the financial path being designated by an amount of financial reward or financial detriment to be attributed to a playing piece upon termination of movement on such interval, at least some of the intervals of the college path being designated by an amount of college credit or college detriment to be attributed to a playing piece upon termination of movement on such interval, at least a few of the other intervals of the college path being designated by an amount of financial reward or financial detriment to be attributed to a playing piece upon termination of movement on such interval, at least a few of the remaining intervals of the college path being designated only by a decision indication;

a plurality of decision cards associated with each decision interval of the college path, each decision card having indicia means thereon for indicating a decisional choice, each decisional choice allowing selection between one of either a financial reward or a financial detriment or one of either a college credit or a college detriment;

a pair of dice, each one of said pair of dice having indicia means for indicating numbers to dictate movement of the playing pieces over the intervals of the paths of said game board whereby financial rewards and detriments and college credits and detriments are attributed to each playing piece in accordance with the intervals upon which movement of the playing piece terminates;

a multiple grade guesser comprising a cover member, a wheel member rotationally attached to the cover member, indicia means formed on the wheel member and indicating a plurality of college credits and college detriments arranged in a predetermined pattern, the cover member defining a plurality of window openings therein arranged in a predetermined pattern to align with and expose a predetermined plurality of college credits and college detriments upon rotation of the wheel member to one of a predetermined plurality of positions, and window cover means associated with each window opening for normally closing each window opening and concealing the aligned college credit or college detriment behind each window, each window cover means being selectively movable for opening each window opening and exposing the college credit or college detriment aligned behind the selected window opening; and at least one of one of said intervals of the college path or one of the decisional choices supplied by the decision cards provides for attributing a college credit or college detriment revealed behind the aligned window opening of the multiple grade guesser upon movement of the selected window cover means, the college credit or college detriment to be attributed to the playing piece terminating movement on such interval.

2. Board game apparatus as defined in claim 1 further comprising:

a transcript card having indicia means thereon for recording a selected number of college classes to which college credits and college detriments will be attributed to each playing piece during movement around the college path, and for recording amounts of college credits and college detriments attributed to each selected college class, and for deriving a performance quotient determined by the mathematical ratio of the total college credits and detriments attributed to each college class divided by the number of college classes to which college credits and detriments have been attributed.

3. Board game apparatus as defined in claim 1 or 2:

wherein at least a few of the intervals of the financial path are designated by an option indication; and further comprising a plurality of option cards associated with each option interval of the financial path, each option card including indicia means designating an amount of financial reward or financial detriment, at least a few of the plurality of option cards having printed indicia thereon different from the other option cards.

* * * * *